US008701913B2

(12) United States Patent
Pack et al.

(10) Patent No.: US 8,701,913 B2
(45) Date of Patent: Apr. 22, 2014

(54) DUAL-RESERVOIR CONTAINER WITH AN INTEGRAL SEAL CAP

(75) Inventors: Todd Denison Pack, San Diego, CA (US); Robert G. States, III, Morrow, OH (US)

(73) Assignee: Meridian Biosciences, Inc., Cincinnati, OH (US)

( * ) Notice: Subject to any disclaimer, the term of this patent is extended or adjusted under 35 U.S.C. 154(b) by 278 days.

(21) Appl. No.: 12/857,307

(22) Filed: Aug. 16, 2010

(65) Prior Publication Data

US 2011/0031252 A1 Feb. 10, 2011

Related U.S. Application Data

(63) Continuation-in-part of application No. 29/335,461, filed on Apr. 16, 2009, now Pat. No. Des. 624,194.

(51) Int. Cl.
*B65D 21/02* (2006.01)

(52) U.S. Cl.
USPC ..... 220/23.8; 220/523; 220/833; 220/839

(58) Field of Classification Search
CPC ..... G01N 33/86; B65D 21/02
USPC ..... 220/23.8, 833, 839, 23.4, 23.6, 507, 220/524, 523, 825, 810, 834
See application file for complete search history.

(56) References Cited

U.S. PATENT DOCUMENTS 2,687,157 A * 8/1954 Cowan ..... 220/4.23
4,671,939 A 6/1987 Mintz
D309,779 S 8/1990 D'Aquino et al.
D316,449 S 4/1991 D'Aquino et al.
5,005,721 A 4/1991 Jordan
5,225,165 A 7/1993 Perlman
5,282,543 A 2/1994 Picozza et al.
5,354,539 A 10/1994 Hovatter
5,382,408 A 1/1995 Perlman
5,577,626 A 11/1996 Henkel et al.
5,683,659 A 11/1997 Hovatter
5,722,553 A 3/1998 Hovatter
5,863,791 A * 1/1999 Baldszun et al. ..... 435/288.1
6,001,310 A 12/1999 Shaffer et al.
6,601,725 B2 8/2003 Lafond et al.
D516,732 S * 3/2006 Sakurai et al. ..... D24/216
2007/0017927 A1 1/2007 D'Amore et al.

* cited by examiner

*Primary Examiner* — Stephen Castellano
(74) *Attorney, Agent, or Firm* — Morrison & Foerster LLP

(57) ABSTRACT

The invention provides a dual-reservoir container for liquid handling. The container includes two reservoirs attached to each other by a bridge means and a base wall, and further includes an integral seal cap connected to the base wall by a fixed hinge means. The seal cap includes a lid, two annular sealing walls extending downward from the lid and adapted to seal the reservoirs, two closed dome-shaped structures extending upward from the lid and the annular sealing walls, a locking tab hingedly attached to and extending substantially co-planar with and outward from the lid, and a lid extension extending upward from the upper lid surface. The locking tab has a longitudinal slot therethrough and can be moved from its normal outwardly position to a securing position in which the longitudinal slot engages a securing member comprised in the base wall, preventing the seal cap from being unseated from the reservoirs.

20 Claims, 4 Drawing Sheets

DUAL-RESERVOIR CONTAINER WITH AN INTEGRAL SEAL CAP

CROSS-REFERENCE TO RELATED APPLICATIONS

This application is a continuation-in-part of design application Ser. No. 29/335,461, filed Apr. 16, 2009, now U.S. Design Pat. No. D624194 which is incorporated herein by reference in its entirety.

FIELD OF THE INVENTION

This invention generally relates to the field of liquid handling. More specifically, the invention relates to test tubes for handling liquid samples and reagents, particularly to dual-reservoir containers with an integral seal cap.

BACKGROUND OF THE INVENTION

Microcentrifuge tubes are small plastic tubes which are usually tapered, conical or rounded, and closed at one end. The tubes are capable of holding approximately 0.4-2.0 ml of liquid, and can withstand forces over 10,000×g during centrifugation. These tubes are used widely in biotechnology laboratories as vessels for storing chemical and biological reagents, for performing biochemical reactions, and for handling sterile contaminant-free samples. They usually have tight-fitting lids whose size and shape protect and cover the perimeter of the tube opening and help maintain the inside of the tube in aseptic condition.

The lids are generally attached to the tubes by a flexible hinge and are sealed to the tube by pressing them downward against a resisting frictional force. In this sealing process, the annular sealing portion of the underside of the lid, shaped to a sealing fit inside the tube opening, is forced downward into the tube and compressed. The lids are secured against accidental opening by a number of means such as friction force-fit of the lid in the tube, integrated lid "catches" which secure the lid to a lip flange provided on the tube, or alternatively by separate lid clamps which may be slid or snapped into place after the lid has been closed. For subsequently aiding in unseating and opening the sealed and optionally secured lid, the generally flat lid opposite the lid hinge is usually extended horizontally beyond the outer diameter of the tube's lip flange to provide a standard lifting tab. A thumb, thumbnail, or opener device may be used to press upward on this tab.

Microcentrifuge tubes are commonly used for clinical testing, wherein a test sample must be analyzed alongside a control sample to reach a conclusive result. In such applications, it is highly desirable that the control sample and the test sample be subjected to virtually identical mechanical and thermal treatments. This can be accomplished by providing an array or assembly of two or more microcentrifuge tubes attached to each other. Various examples of such arrays and assemblies have been described in the prior art; see, for example, U.S. Pat. Nos. D309,779; D316,449; 4,671,939; 5,005,721; 5,282,543; 5,683,659; 5,722,553; 6,001,310; 6,601,725; and U.S. Pub. No. 2007/0017927. However, there remains a need for improved microcentrifuge tube arrays that are robust, easy to handle, and inexpensive to manufacture. The present invention addresses this need.

SUMMARY OF THE INVENTION

An object of the present invention is to provide a dual-reservoir container that is robust, easy to handle, and inexpensive to manufacture, and that can be used in clinical or laboratory settings for parallel testing of two samples, such as a test sample and a control sample, two test samples, or two control samples.

Accordingly, in one aspect, the present invention provides a container for handling a liquid sample, including two hollow reservoirs. Each reservoir has an outside surface and an inside surface. Both surfaces have substantially cylindrical upper portions, which are referred to herein as the upper outside surface and the upper inside surface, respectively. The upper inner surfaces of the two reservoirs define substantially circular openings. The reservoirs are connected to each other via a bridge means that is attached to both reservoirs orthogonally to the upper outer surfaces. The presence of the bridge means stabilizes the assembly and minimizes a relative motion between the reservoirs during handling. The container also includes a planar base wall attached orthogonally to the bridge means and to upper edges of the reservoirs. The base wall further stabilizes the assembly and features a securing member that extends substantially co-planar with and outward from the base wall and is used as part of a locking mechanism. The container further includes a seal cap attached to the base wall by one or more fixed hinge means.

The seal cap includes several structural elements that play distinct functional roles. First, the seal cap includes a lid that is substantially planar and has an upper lid surface and a lower lid surface. Next, the seal cap includes two annular sealing walls that extend downward from the lower lid surface and are adapted to fit within the openings and sealingly mate with the upper inner surfaces of the two reservoirs. The seal cap further includes two closed dome-shaped structures extending upward from the annular sealing walls and the upper lid surface. In some embodiments, the closed dome-shaped structures are resiliently deformable in order to withstand the high pressures that tend to form within the sealed reservoirs at elevated temperatures. In addition, the seal cap includes a locking tab that is hingedly attached to the lid and extends substantially co-planar with and outward from the lower lid surface. The locking tab contains a longitudinal slot therethrough and can be moved from its resting outwardly position to a securing position in which the longitudinal slot engages the securing member, thus preventing the seal cap from being unseated from the reservoirs. Finally, the seal cap includes a lid extension that extends upward from the upper lid surface, which can be used as a lever to unseat and move the seal cap from the reservoirs without touching the edges of the openings.

DETAILED DESCRIPTION OF THE INVENTION

Figure 1:
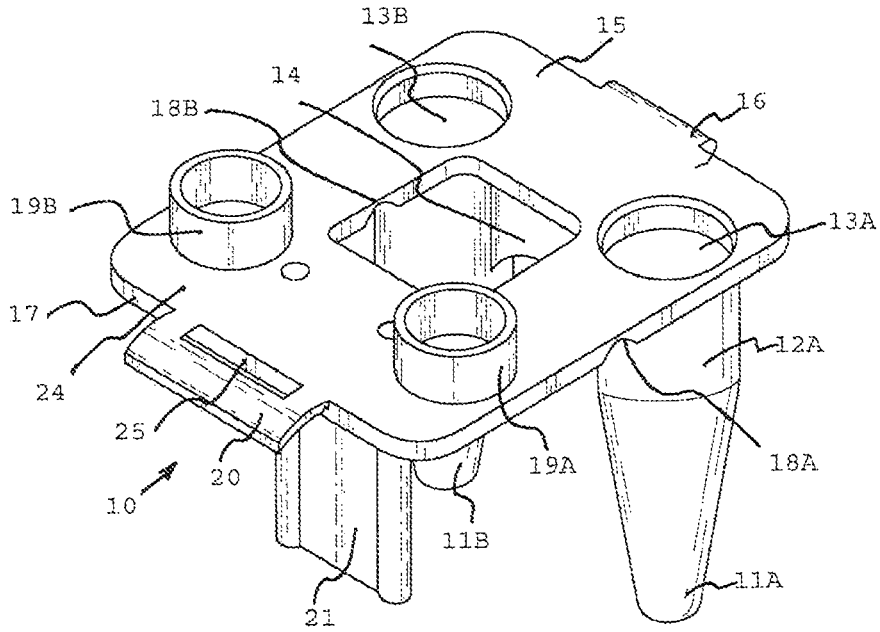
FIG. 1 is a top perspective view of a dual-reservoir container with an integral seal cap according to an embodiment of the present invention, shown in the open configuration.

Unless defined otherwise, all technical and scientific terms used herein have the same meaning as is commonly understood by one of ordinary skill in the art to which this invention belongs. All patents, patent applications (published or unpublished), and other publications referred to herein are incorporated by reference in their entireties. If a definition set forth in this section is contrary to or otherwise inconsistent with a definition set forth in the patents, applications, published applications and other publications that are incorporated herein by reference, the definition set forth in this section prevails over the definition that is incorporated herein by reference.

Citation of publications or documents is not intended as an admission that any of such publications or documents are pertinent prior art, nor does it constitute any admission as to the contents or date of these publications or documents.

As used herein, the term "a" or "an" means "at least one" or "one or more."

As used herein, the term "about" or "approximately" refers to a range of values within plus or minus 10% of the specified number.

As used herein, the term "substantially" means that the actual value is within about 10% of the actual desired value, particularly within about 5% of the actual desired value and especially within about 1% of the actual desired value of any variable, element or limit set forth herein. Accordingly, as used herein, the expressions "substantially co-planar," "substantially circular," and "substantially cylindrical" refer to geometric relationships and shapes that are preferably within about 10%, more preferably within about 5%, and most preferably within about 1% of the perfect co-planarity, perfect circle, and perfect cylinder, respectively.

As used herein, the term "sample" refers to any medium suspected of containing an analyte, such as a binding partner, the presence or quantity of which is desirably determined. The sample can be a biological sample such as a cell, cell lysate, tissue, serum, blood, stool, or other fluid from a biological source, a biochemical sample such as products from a cDNA library, an environmental sample such as a soil extract, or any other medium, biological or chemical, including synthetic material, that can be evaluated using the claimed invention.

As used herein, the term "reservoir" refers to any plastic structure having a closed end and an open end that can be used for storing and handling a liquid sample, for example, a microcentrifuge tube.

As used herein, the term "bridge means" refers to any suitable solid structure that is permanently attached to two adjacent reservoirs to form a rigid link between them.

As used herein, the term "attached" or "connected" refers to the joining, adhering, bonding, or the like, of at least two structural elements. As used herein, two elements are considered to be attached or connected to each other when they are joined directly or indirectly to one another, such as when each is directly attached to one or more intermediate elements.

As used herein, the term "orthogonal" or "orthogonally" refers to a substantially perpendicular relationship between bodies, axes, and surfaces.

As used herein, the expression "hinge means" generally refers to a jointed or flexible device that connects and permits pivoting or turning of a part relative to a stationary component. The expression "fixed hinge means" refers to a hinge means that is immobilized relative to the stationary component. Accordingly, the expression "hingedly attached" refers to a mode of connection involving at least one hinge means.

As used herein, the expression "resiliently deformable" refers to the ability of a body to recover its size and form, at least partially, following deformation. This definition does not imply that the body must recover fully to its original shape and size when the deformation effort is removed. Rather, the definition intends to encompass situations where the shape and size recovery is only partial.

Turning now to the Figures, container 10 is usually injection molded as a single piece from polypropylene or polyethylene. Each of reservoirs 11 has an upper outside surface 12 and an upper inner surface that defines an opening 13. The height of the reservoirs 11 preferably ranges from about 1.5 cm to about 5.0 cm, more preferably from about 1.6 cm to about 3.5 cm, and most preferably from about 1.7 cm to about 2.0 cm. In some embodiments, the height of the reservoirs 11 is approximately 1.9 cm. The diameter of the openings 13 preferably ranges from about 4 mm to about 10 mm, more preferably from about 5 mm to about 8 mm. In some embodiments, the diameter of the openings 13 is approximately 5.3 mm. The centers of the reservoirs 11 are preferably spaced about 1.0 cm to about 3.0 cm, more preferably about 1.2 cm to about 2.0 cm from each other. In some embodiments, the centers of the reservoirs are spaced approximately 1.4 cm from each other.

Figure 2:
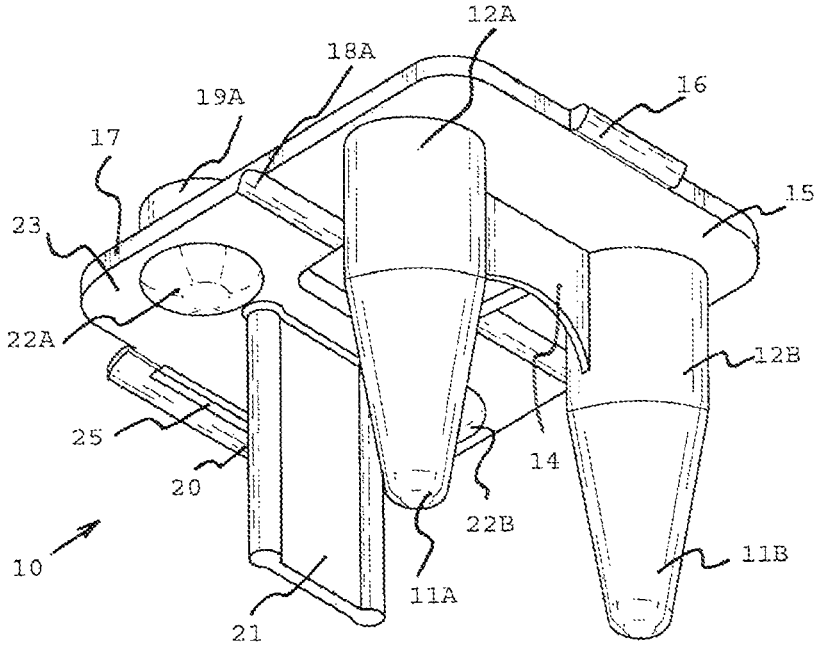
FIG. 2 is a bottom perspective view of the dual-reservoir container shown in FIG. 1.
Figure 3:
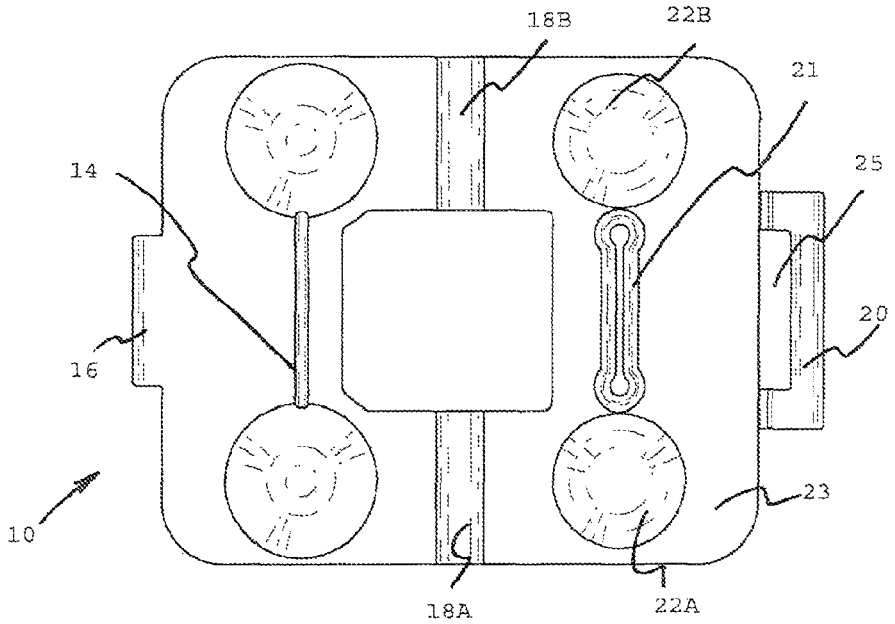
FIG. 3 is a bottom plan view of the dual-reservoir container shown in FIG. 1.
Figure 4:
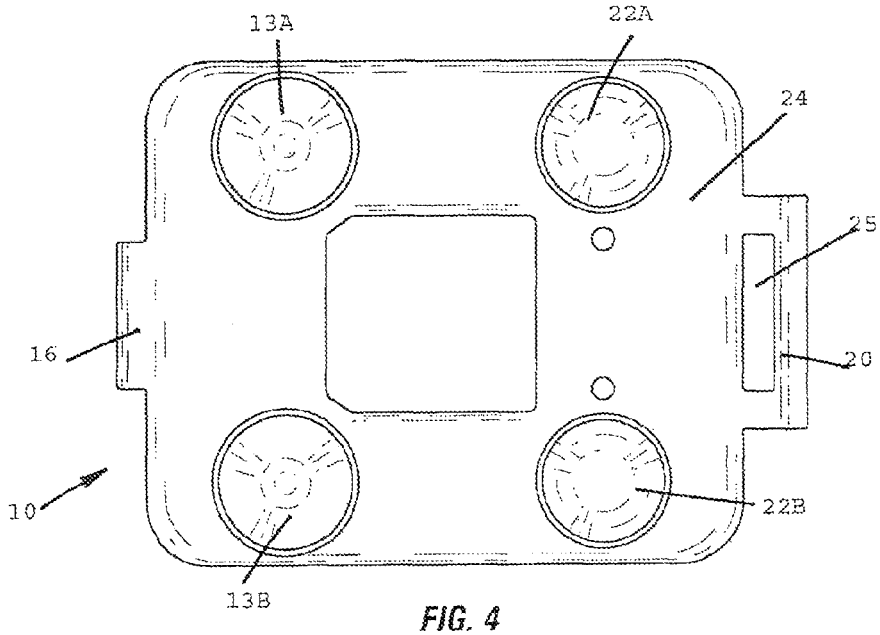
FIG. 4 is a top plan view of the dual-reservoir container shown in FIG. 1.
Figure 5:
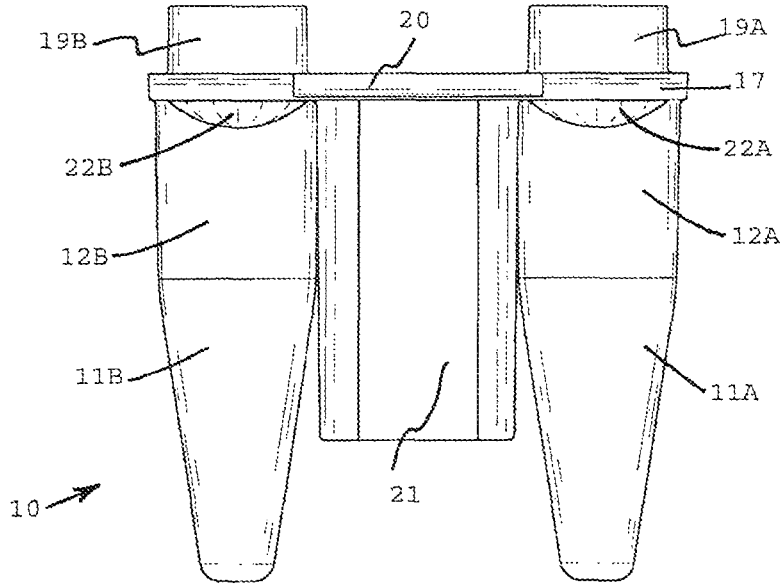
FIG. 5 is a rear elevational view of the dual-reservoir container shown in FIG. 1.
Figure 6:
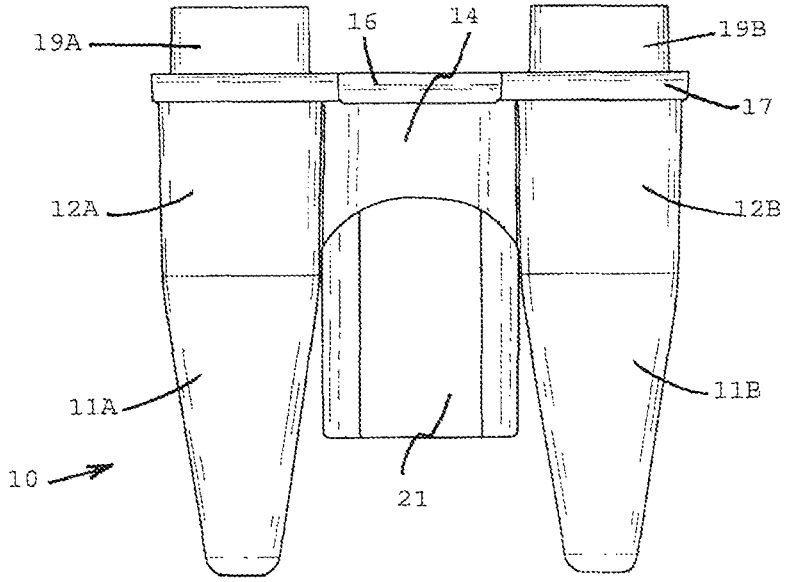
FIG. 6 is a front elevational view of the dual-reservoir container shown in FIG. 1.
Figure 7:
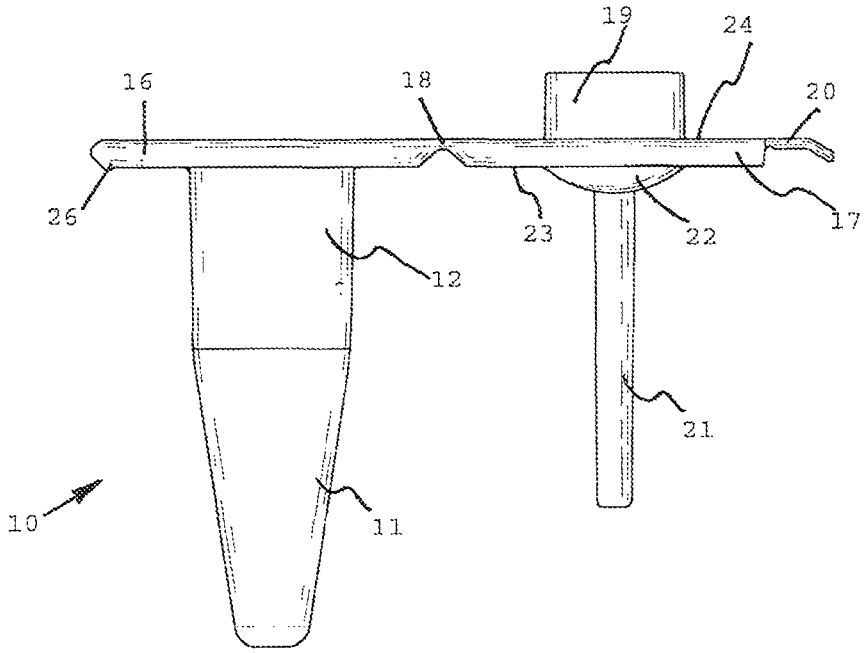
FIG. 7 is a side elevational view of the dual-reservoir container shown in FIG. 1, the opposite side being identical thereto.

As can be seen in FIGS. 2 and 6, the reservoirs are connected by a bridge means 14, which is attached orthogonally to the upper outside surfaces 12. The bridge means 14 can be made from any suitable plastic material of sufficient thickness and rigidity to minimize relative rotational and lateral movements of the reservoirs during handling. Additionally, the reservoirs are connected by a base wall 15, which is attached orthogonally to the bridge means 14 and to upper edges of the reservoirs 11. As noted above, the base wall 15 further stabilizes the dual-reservoir assembly and includes a securing member 16 that extends substantially co-planar with and outward from the base wall 15. As can be seen in FIG. 7, the securing member 16 comprises an engagement edge 26 that works in combination with a locking tab 20 to secure the container 10 in a sealed configuration. The base wall 15 is hingedly attached to a seal cap 17 by a fixed hinged means 18. The fixed hinge means 18 preferably consists of a thin plastic wall connecting the seal cap 17 to the base wall 15 and representing the rotation axis of the seal cap movement. In some embodiments, the base wall can be attached to the seal cap by two fixed hinge means 18A and 18B, as shown in FIGS. 1-3.

As noted above, the seal cap 17 includes a number of important structural elements. First, it includes a lid having an upper lid surface 23 and a lower lid surface 24. Two annular sealing walls 19 extend downward from the lower lid surface 24 and are adapted to fit within the openings 13 and sealingly mate with the upper inner surfaces of the reservoirs 11. Further, two closed dome-shaped structures 22 extend upward from the annular sealing walls 19 and the upper lid surface 23. In some embodiments, the closed dome-shaped structures 22 are resiliently deformable in order to withstand the high pressures that tend to form within sealed reservoirs at elevated temperatures. It is noted that the terms "downward" and "upward" as used in this context relate to the sealed configuration of the container 10 (not shown). Since the drawings refer to the open container configuration, as shown in FIGS. 1-7, the annular sealing walls 19 extend upward from the lower lid surface 24, and the closed dome-shaped structures 22 extend downward from the upper lid surface 23.

The seal cap 17 also includes a locking tab 20 that is hingedly attached to the lid and extends substantially co-planar with and outward from the lower lid surface 24. The locking tab 20 contains a longitudinal slot 25 therethrough and can be moved from its resting outwardly position to a securing position in which the slot engages the securing member 16, including the engagement edge 26, thus preventing the seal cap 17 from being unseated from the reservoirs 11. Finally, the seal cap 17 includes a lid extension 21 that extends upward from the upper lid surface 23, which can be used as a lever to unseat and move the seal cap 17 from the reservoirs 11 without touching the edges of the openings 13. Once again, it is noted that the term "upward" as used in this context relates to the sealed configuration of the container 10 (not shown). Since the drawings refer to the open container configuration, as shown in FIGS. 1-7, the lid extension 21 extends downward from the upper lid surface 23.

The lid extension 21 is preferably positioned between the closed dome-shaped structures 22. In some embodiments, as shown in FIGS. 1-7, the lid extension 21 is spaced approximately evenly between the closed dome-shaped structures 22. The length of the lid extension 21 preferably ranges from about 0.5 cm to about 3.0 cm, more preferably from about 1.0 cm to about 2.0 cm. In some embodiments, the length of the lid extension is approximately 1.3 cm. The width of the lid extension 21 preferably ranges from about 0.5 cm to about 2.0 cm, more preferably from about 0.6 cm to about 1.0 cm. In some embodiments, the width of the lid extension is approximately 8 mm. The angle formed by the lid extension 21 and the upper lid surface 23 preferably ranges from about 80° to about 100°, more preferably from about 85° to about 95°. In some embodiments, the angle between the lid extension 21 and the upper lid surface 23 is approximately 90°. In some embodiments, the lid extension 21 is attached to the lid within a half of the upper lid surface 23 that is proximal to the locking tab 20. In some embodiments, as shown in FIGS. 1-7, the lid extension 21 may be attached to the lid approximately at the center of the upper lid surface 23. Due to its appreciable surface area and prominent position, the lid extension 21 can be advantageously used for labeling and identifying samples in the reservoirs 11. Accordingly, in some embodiments, the lid extension 21 comprises a surface that is capable of receiving and retaining indicia of sample identification markings. In some embodiments, the lid extension 21 is formed as an integral part of a thermoplastic seal cap.

The dual-reservoir container 10 described herein is robust, inexpensive to make, and easy in operation. As noted above, the presence of the bridge means 14 and the base wall 15 greatly stabilize the container thereby minimizing rotational and lateral motions of the reservoirs relative to each other. Consequently, a user can open and close both reservoirs simultaneously by holding one or both of them in one hand and pulling the lid extension 21 upward or pushing it downward with the other. The locking and unlocking of the securing mechanism can also be accomplished in one step by pressing the locking tab 20 downward or upward to engage or disengage the securing member 16, respectively. The presence of the base wall significantly reduces the likelihood of sample contamination due to a user's fingers touching the edges of the reservoirs 11 around the openings 13. It is noted, however, that the simple and robust design of the dual-reservoir container disclosed herein easily lends itself to automatic as well as manual handling modes, both of which are contemplated within the present invention.

The preceding exemplary embodiments are provided for illustrative purposes only and are not intended to limit the scope of the present invention. It is further recognized that various embodiments can be made without departing from the spirit and scope of the present invention by those skilled in the art in light of the present disclosure. It is therefore understood that the present invention embraces all equivalents herein.

The invention claimed is:

1. A container for handling a liquid sample, comprising:

two reservoirs, each having an upper outside surface, an upper inside surface, and an opening defined by said upper inner surface;

a bridge means attached orthogonally to said upper outer surfaces, whereby a relative motion of the reservoirs is minimized;

a base wall attached to said bridge means and to upper edges of said reservoirs, said base wall comprising a securing member extending substantially co-planar with and outward from the base wall; and a seal cap attached to said base wall by a fixed hinge means, said seal cap comprising:

a lid having an upper lid surface and a lower lid surface;

two annular sealing walls extending downward from said lower lid surface and adapted to fit within said openings and sealingly mate with said upper inner surfaces, wherein the inner diameter of said annular sealing wall is smaller than the diameter of the opening;

two closed dome-shaped structures extending upward from said annular sealing walls and said upper lid surface;

a locking tab hingedly attached to said lid and extending substantially co-planar with and outward from said lower lid surface, said locking tab having a longitudinal slot therethrough and being movable from its outwardly position to a securing position in which said longitudinal slot engages said securing member, whereby said seal cap is prevented from being unseated from said reservoirs; and a lid extension extending upward from said upper lid surface, whereby said seal cap can be unseated and moved from said reservoirs.

2. The container of claim 1, wherein said container is made from polypropylene or polyethylene.

3. The container of claim 1, wherein said reservoirs and said seal cap are made from the same or different polymers.

4. The container of claim 1, wherein said closed dome-shaped structures are resiliently deformable.

5. The container of claim 1, wherein said lid extension is positioned between said closed dome-shaped structures.

6. The container of claim 5, wherein said lid extension is spaced approximately evenly between said closed dome-shaped structures.

7. The container of claim 1, wherein said lid extension has a length from about 0.5 cm to about 3.0 cm.

8. The container of claim 7, wherein said lid extension has a length from about 1.0 cm to about 2.0 cm.

9. The container of claim 8, wherein said lid extension has a length of approximately 1.3 cm.

10. The container of claim 1, wherein said lid extension extends upward from said upper lid surface at an angle from about 80° to about 100°.

11. The container of claim 10, wherein said lid extension extends upward from said upper lid surface at an angle from about 85° to about 95°.

12. The container of claim 11, wherein said lid extension extends upward from said upper lid surface at an angle of approximately 90°.

13. The container of claim 1, wherein said lid extension is formed as an integral part of a thermoplastic seal cap.

14. The container of claim 1, wherein said lid extension comprises a surface capable of receiving and retaining indicia of sample identification markings.

15. The container of claim 1, wherein said lid extension is attached to said lid within a half of said upper lid surface that is proximal to said locking tab.

16. The container of claim 1, wherein said lid extension is attached to said lid approximately at the center of said upper lid surface.

17. The container of claim 1, wherein said seal cap is connected to said base wall by at least two fixed hinge means.

18. The container of claim 1, wherein said securing member comprises an engagement edge that prevents disengagement of said locking tab from said securing member.

19. The container of claim 1, wherein said reservoirs have centers being spaced about 1.0 cm to about 3.0 cm from each other.

20. The container of claim 19, wherein said reservoirs have centers being spaced approximately 1.4 cm from each other.

* * * * *